US012774653B2

(12) United States Patent
Aulia et al.

(10) Patent No.: US 12,774,653 B2
(45) Date of Patent: Oct. 27, 2026

(54) SIDEWALL TUBULAR CLEANER AND SAMPLING TOOL

(71) Applicant: Saudi Arabian Oil Company, Dhahran (SA)

(72) Inventors: Fahmi Aulia, Udhailiyah (SA); Saud Alabdulqader, Al Hassa City (SA); Naif Hisham Al Afaliq, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/011,746

(22) Filed: Jan. 7, 2025

(65) Prior Publication Data

US 2026/0193983 A1 Jul. 9, 2026

(51) Int. Cl.

| | |
|---|---|
| ***E21B 49/10*** | (2006.01) |
| ***E21B 37/02*** | (2006.01) |
| ***E21B 49/06*** | (2006.01) |
| ***E21B 49/08*** | (2006.01) |

(52) U.S. Cl.

CPC ..... *E21B 49/10* (2013.01); *E21B 37/02* (2013.01); *E21B 49/06* (2013.01); *E21B 49/08* (2013.01)

(58) Field of Classification Search

CPC ..... E21B 49/10; E21B 37/02; E21B 49/06; E21B 49/08

See application file for complete search history.

(56) References Cited

U.S. PATENT DOCUMENTS

| | | | | | |
|---|---|---|---|---|---|
| 794,806 | A * | 7/1905 | Leggett | E21B 49/082 | 166/99 |
| 5,819,353 | A * | 10/1998 | Armell | E21B 37/02 | 166/173 |
| 6,412,575 | B1 * | 7/2002 | Harrigan | E21B 10/48 | 175/332 |
| 9,752,403 | B1 * | 9/2017 | Frey | E21B 29/005 | |
| 2002/0148643 | A1 * | 10/2002 | Contreras | E21B 49/06 | 175/58 |
| 2005/0016302 | A1 * | 1/2005 | Simpson | E21B 47/00 | 73/865.8 |
| 2009/0218100 | A1 * | 9/2009 | Williams | E21B 28/00 | 166/173 |
| 2012/0118571 | A1 * | 5/2012 | Zhou | E21B 31/08 | 166/99 |
| 2014/0377873 | A1 * | 12/2014 | Hay | E21B 47/002 | 436/29 |

(Continued)

*Primary Examiner* — Neel Girish Patel

(74) *Attorney, Agent, or Firm* — DINSMORE & SHOHL LLP

(57) ABSTRACT

A downhole cleaner-sampler device includes a structure having a first section, a second section, and a third section aligned on an axis. The first section includes a housing, a suction pump arranged in the housing, a rotary motor arranged in the housing, and a first sampler. The first sampler defines an inlet, an outlet, and a fluid channel connecting the inlet and outlet. The second section is rotatable relative to the first section. The second section has a first hub, a second hub, and a plurality of extendable brushing arms arranged between the first hub and the second hub. Each brushing arm includes a first link hingably connected to the first hub, a second link hingably connected to the second hub, and a brush arranged between the first and second links. The third section has a second sampler.

20 Claims, 7 Drawing Sheets

(56) References Cited

U.S. PATENT DOCUMENTS

| | | | | |
|---|---|---|---|---|
| 2015/0377019 | A1* | 12/2015 | Gleitman | H04W 36/0088 175/45 |
| 2016/0061006 | A1* | 3/2016 | Krueger | E21B 37/02 166/174 |
| 2018/0283118 | A1* | 10/2018 | Vander Velde | E21B 31/08 |
| 2020/0364623 | A1* | 11/2020 | Al-Hajri | C01F 11/18 |
| 2024/0295162 | A1* | 9/2024 | Ali | E21B 49/081 |

* cited by examiner

SIDEWALL TUBULAR CLEANER AND SAMPLING TOOL

TECHNICAL FIELD

This disclosure relates to methods and system for scale removal, and more particularly to removal and collection of partial obstructions in a tubular wellbore casing.

BACKGROUND

During day to day well intervention activities, such as remedial work, pressure, or temperature survey and logging activities, wellbore obstructions may be encountered which prevent a downhole tool from reaching to the target depth within a wellbore. Wellbore obstructions can hinder well enhancement activity, well integrity surveillance, and reservoir data collection. Descaling or clean-out jobs can be run after identifying the type of obstruction or scale in the wellbore or run without identifying the type of obstruction or scale in the wellbore. In order to identify the type of obstruction present, a downhole sample must be collected.

Sand bailers and hydrostatic bailers may be used to help with downhole sample identification. However, sand bailers and hydrostatic bailers can only be used where total or complete blockage obstructions exist and they do not always succeed in acquiring the sample. Where only a partial obstruction is present within the wall of the tubular, not a total blockage, sand bailers and hydrostatic bailers cannot be used. Additionally, sand bailers and hydrostatic bailers are incapable of cleaning out these types of obstructions. A milling tool is typically used to remove the scale in a separate run-in operation.

SUMMARY

In certain aspects, a downhole cleaner-sampler device includes a first connection end and a second free end. The first end and second end define a device axis. The structure extends from the first end to the second end of the device. The structure includes a first section, a second section, and a third section. The first section includes a housing with a link jar at a first end of the device, a suction pump arranged in the housing, a rotary motor arranged in the housing, and a first sampler. The first sampler includes a body connected to the housing. The body defines an inlet, an outlet, and a fluid channel connecting the inlet and outlet. The suction pump is fluidly connected to the fluid channel. The second section centered on the device axis and rotatable relative to the first section. The second section includes a first hub having a swivel joint connector attached to the first section of the structure, a second hub, and a plurality of extendable brushing arms arranged between the first hub and the second hub. Each brushing arm includes a first link hingably connected to the first hub, a second link hingably connected to the second hub, and a brush arranged between the first and second links. The brush is hingably connected to the first link and hingably connected to the second link. The third section arranged at the second end of the structure of the device. The third section connects to the second hub of the second section and is centered on the device axis. The third section includes a second sampler.

In some devices, the first sampler also includes a filter arranged in the fluid channel between the inlet and outlet.

Some first samplers have a junk basket arranged in the fluid channel between the inlet and the outlet. The junk basket can include at least one filter liner arranged in the fluid channel between the inlet and the outlet.

The first sampler can extend from a first end to a second end. The body can be connected to the housing at the first end. The outlet of the first sampler can be arranged between the inlet of the first sampler and the housing first end of the housing. Some inlets of the first sampler are arranged at or adjacent to the second end of the body. In some cases, the swivel joint connector is mounted to the second end of the first sampler.

Some second samplers are junk baskets having an open end, a porous closed end, and a wall extending between the open end and the closed end. The wall can include a permeable membrane or mesh. The second section can be rotatable relative to the third section. Some second hubs include a second swivel joint and some second swivel joints are connected to the third section of the body.

In some embodiments, the second section is operable to move between a retracted position and an extended position.

Some devices also include a computer system include having a controller; one or more processors, and a non-transitory computer-readable medium storing instructions executable by the one or more processors to perform operations. The operations can include prompting the rotary motor to rotate the second section relative to the first section and prompting the suction pump to apply suction to the fluid channel of the first sampler of the first section. In some cases, the operations further include prompting the plurality of brushing arms to move from a retracted position to an extended position. I n some embodiments, the operations further include prompting the plurality of brushing arms to move from an extended position to a retracted position.

In certain aspects, a method includes providing a cleaner-sampler device in a wellbore casing with a partial blockage. The device includes a first section, a second section, and a third section. The first section has a first sampler defining an inlet, an outlet, and a fluid channel extending between the inlet and the outlet. The second section has a plurality of brushing arms in the retracted position. The third section has a second sampler. The method also includes contacting an interior surface of a wellbore casing or scale deposits attached to the interior surface of the wellbore casing by brushes of each of the brushing arms in the plurality of brushing arms contact. The plurality of brushes are in the extended position. The method includes dislodging the scale deposits attached to the interior surface of the wellbore casing and capturing the dislodged scale deposits in the first sampler by applying a suction force to the fluid channel by a suction pump in the first section of the device.

In some methods, dislodging the scale deposits attached to the interior surface of the wellbore casing includes rotating the second section relative to the first section.

Some methods also include capturing dislodged scale deposit in the second sampler by moving uphole.

In some cases, dislodging the scale deposits attached to the interior surface of the wellbore casing and capturing the dislodged scale deposits in the first sampler by applying the suction force to the fluid channel, occur simultaneously.

Some methods also include expelling filtered fluid from the outlet of the first sampler.

The details of one or more embodiments are set forth in the accompanying drawings and the description below. Other features, objects, and advantages will be apparent from the description and drawings, and from the claims.

BRIEF DESCRIPTION OF DRAWINGS

Like reference symbols in the various drawings indicate like elements.

DETAILED DESCRIPTION

This disclosure relates to a cleaning-sampling device and method for cleaning a tubular wellbore casing with a partial blockage and collecting the dislodged blockage in a sample collector in a single run. The cleaning and sample collection operations can be performed simultaneously or in sequence during the same run. The device includes extendable brushes or scrapers to dislodge material (e.g., scale, fill, debris, wax) that is mounted or attached to the interior surface of the wellbore casing. The dislodged material can then be collected by a first sampler uphole of the brushes or a second sampler (e.g., a junk basket) downhole of the brushes. The first sampler includes fluid circuit connected to a suction pump. While debris is dislodged into the wellbore, the suction pump sucks the fluid-debris mixture into the first sampler. A filter or junk basket in the first sampler separates the dislodged debris from the fluid and retains the dislodged debris. The first and second samplers are removeable, separable, or otherwise accessible to so that an operator at the surface can access the collected sample retained in the first and second samplers after the device is removed from the wellbore.

Figure 1A:
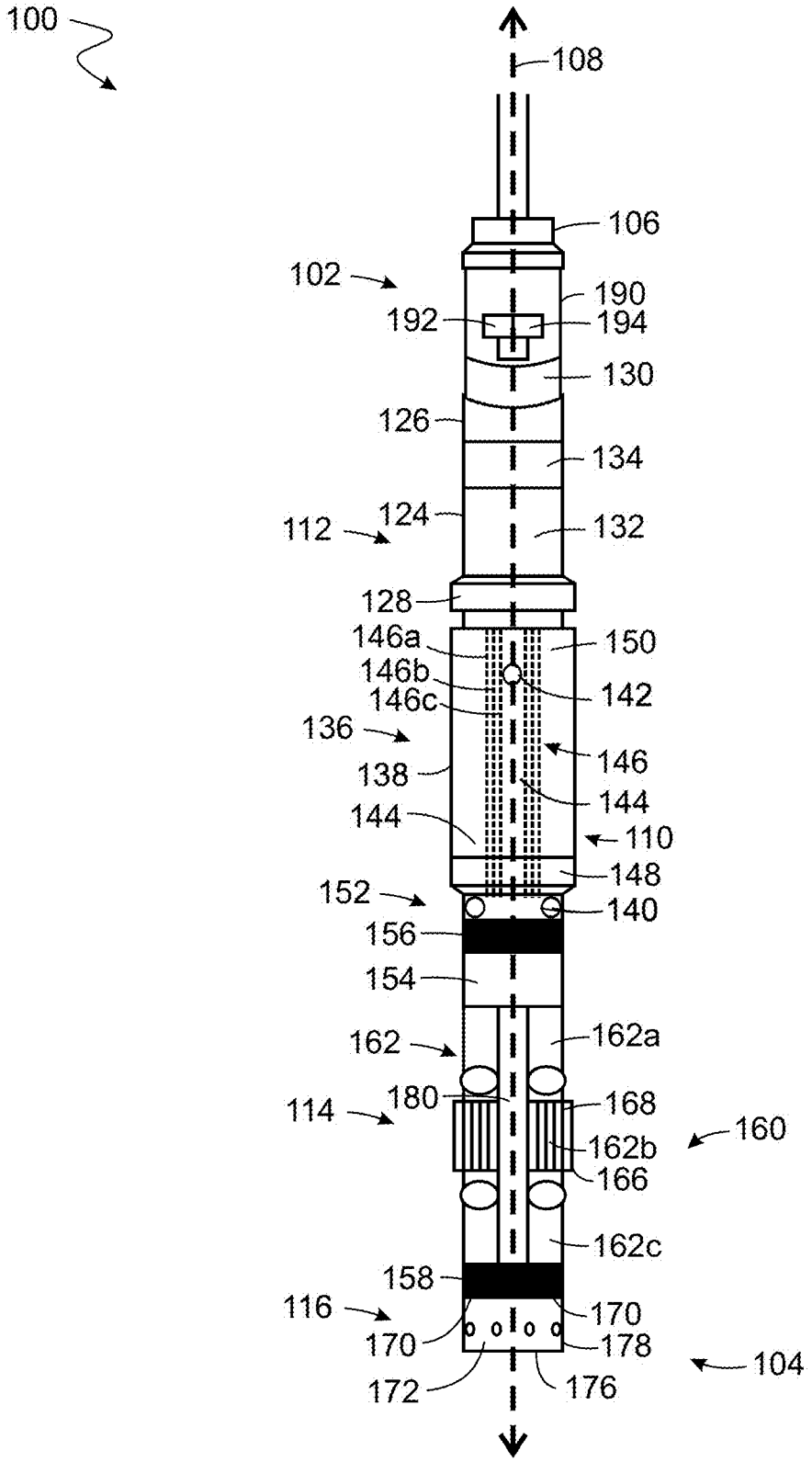
FIGS. 1A and 1B are front views of a cleaning and sampling downhole tool in the retracted position and the extended position, respectively.
Figure 1B:
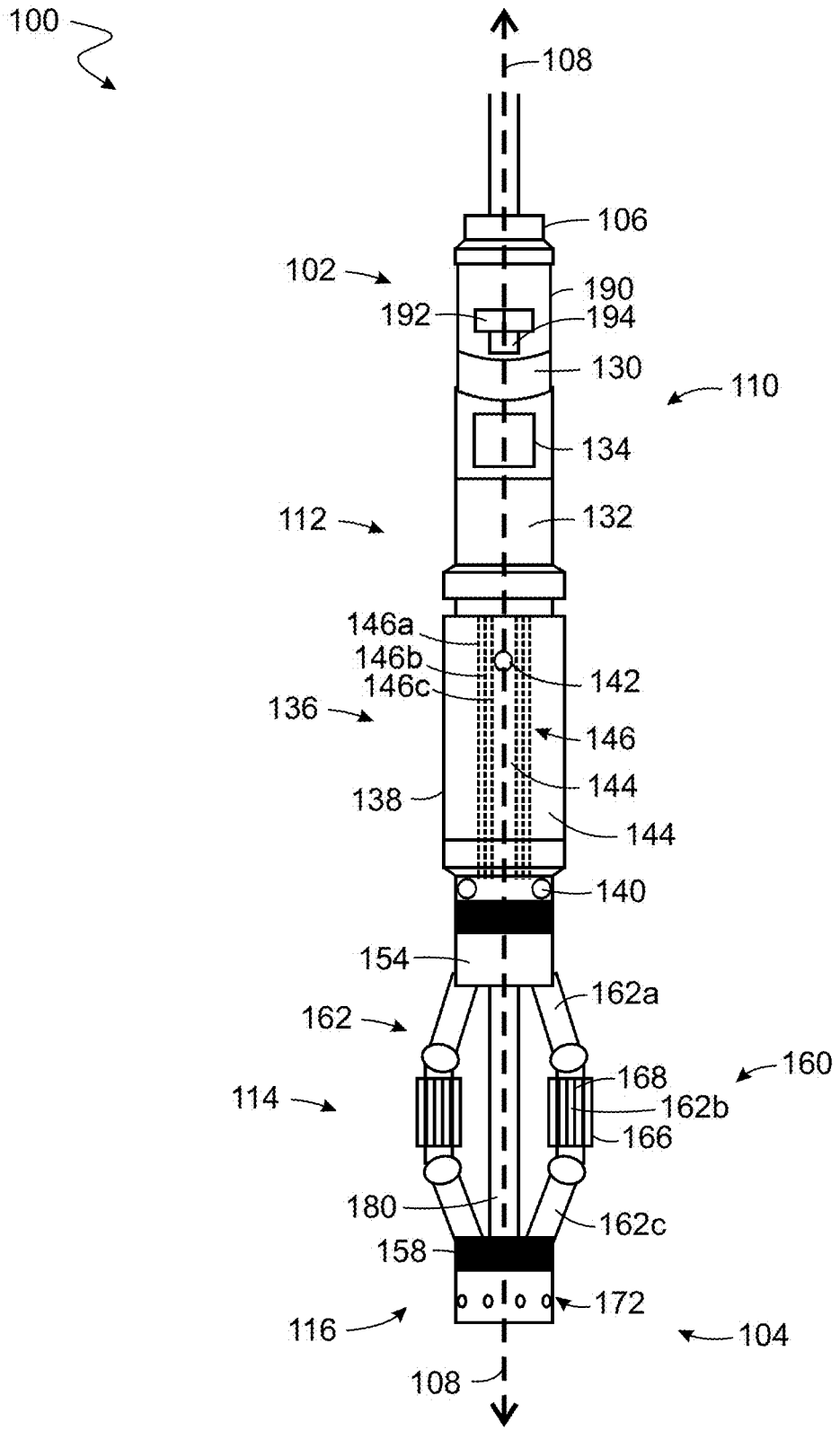

FIGS. 1A and 1B are front views of a cleaning and sampling downhole tool 100 (downhole cleaner-sampler tool, cleaner-sampler device, downhole device, sampling device, collection apparatus, collector, cleaner, cleaning apparatus, scraper, scraping and sampling tool) in the retracted position and the extended position, respectively. The downhole cleaner-sampler tool 100 includes a first connection end 102 and a second, free end 104. The connection end 102 is connectable or mountable to an electric wireline 106. The first end 102 and second end 104 define a device axis 108. The tool 100 is centered on the device axis 108 and translates uphole or downhole along the axis 108.

The tool 100 also includes a structure 110 extending from the first end 102 to the second end 104 of the tool 100. The structure 110 has a first section 112 (first collector, uphole section), a second section 114 (cleaner, intermediate section), and a third section 116 (second collector, downhole section). The second section 114 is arranged between the first section 112 and the third section 116. In use, the first and third sections 112, 116 collect debris 118 dislodged from an interior surface 120 of a wellbore casing 122 while the second section 114 dislodges the debris and cleans the interior surface 120 of the casing 122. The second section 114 is rotatable relative to the first section 112. The third section 116 is fixed to the first section 112 by a central shaft 180. In this configuration, brushing arms of second section 114 to rotate independently around the axis 108. The first and third sections 112, 116 are rotationally constrained and together are static relative to each other, whereas the second section is rotatable relative to the first and third sections.

The first section 112 is arranged at, extends from, or at least partially forms the first end 102 of the tool 100. The first section 112 of the structure 110 of the tool 100 includes a housing 124 with a first (uphole, wireline connection) end 126 and a second (downhole, cleaner connection) end 128. A link jar 130 of the first section 112 is arranged at a first end 102 of the tool 100. In some cases, the link jar is arranged at, is connected to, or forms the first end of the housing of the first section. The link jar 130 connects to the wireline 106. The link jar 130 allows jarring up and down when needed, for example, if the tool 100 becomes stuck or trapped in the wellbore casing 122. The first section 112 also includes a suction pump 132 arranged in the housing 124 of the first section 112 and a rotary motor 134 arranged in the housing 124 of the first section 112.

The first section 112 has a first sampler 136. The first sampler 136 includes a body 138 connected to the housing 124, for example, by threads. The body 138 defines an inlet 140, an outlet 142, and a fluid channel 144 extending from the inlet 140 to the outlet. A filter liner set 146 of the first sampler 136 arranged in the channel 144 between the inlet 140 and the outlet 142 separates debris from fluid flowing through the fluid channel 144. The first sampler 136 and/or body 138 includes a removable junk basket 148 arranged in the fluid channel 144. In some cases, the junk basket at least partially defines the fluid channel. The junk basket 148 arranged in the channel 144 between the inlet 140 and the outlet 142. The junk basket 148 is removable from the first section 112 by an operator at the surface.

The junk basket 148 includes the filter liner set 146 such that removal of the junk basket 148 at the surface also removes the filter liner set 146 and any debris contained within the filter liner set 146. The filter liner set 146 includes a first liner 146*a*, a second liner 146*b*, and a third liner 146*c*. Each liner 146*a-c* is centered on the axis 108 and extends between the inlet 140 and the outlet 142. The second liner 146*a* is arranged concentrically on the axis, within the first liner 146*b*. The third liner 146*c* is arranged concentrically within the second liner 146*b* and the first liner 146*a*. In this nested or concentric configuration, the third liner 146*c* is downstream from the second liner 146*b* and the second liner 146*b* is downstream of the first liner 146*a*.

Each liner in the liner set has a known mesh size, for example, a mesh size of about 20 microns to about 100 microns. The mesh size of the filter liner in the filter liner set controls the minimum debris size that can be captured and retained in the filter liner. A filter liner with mesh size of about 100 microns can retain and store debris larger than 100 microns. In the filter set 146, the first mesh size of the first filter 146*a* is greater than a second mesh size of the second filter liner 146*b*. The second mesh size of the second filter 146*b* is greater than a third mesh size of the third filter 146*c*. The first filter liner 146*a* collects larger debris as compared to the second and third filter liners 146*b*, 146*c*. The second filter liner 146*b* collects larger debris as compared to the third filter liner 146*c*. In this configuration, the debris is presorted into layer of decreasing debris size when the operator removes the junk filter 148 at the surface. While a filter set has been described as having three concentrically arranged filter liners, some filter liner sets have less than three or more than three filter liners.

In use, a fluid-debris mixture enters the fluid channel 144 through the inlet 140. As the fluid-debris mixture moves through the fluid channel 144, the debris-fluid mixture must pass through the first filter liner 146*a* of the filter liner set 146. The first filter liner 146*a* separates the debris at or above the first mesh size from the debris-fluid mixture. Fluid and debris smaller than the first mesh size pass through the first filter liner 146*a* until interacting with the second filter liner 146*b*. The second filter liner 146*b* separates the debris at or above the second mesh size from the debris-fluid mixture. Fluid and debris smaller than the second mesh size pass through the second filter liner 146*b* until interacting with the third filter liner 146*c*. The third filter liner 146*c* separates the debris at or above the third mesh size from the debris-fluid mixture. Fluid and any debris smaller than the third mesh size pass through the third filter liner 146*c* and can be considered "cleaned" or "filtered" fluid. The cleaned fluid is conveyed to the outlet 142, then is then conveyed (e.g., discharges, ejected, sprayed) into the wellbore, through the outlet 142 of the first sampler 136. The first section 112 is connected to the first sampler 136, for example, by threads at the connection end 128.

In some cases, the junk basket is a fluid permeable body, for example, a meshed body in the form of a cup or bowl. In some cases, a filter liner is the meshed body and the junk basket has a basket frame to which the filter liner attaches. A filter liner or filter liner set can line the junk basket or extend into the junk basket as the filter collects more debris. The junk basket includes a fluid permeable structure, for example a meshed structure or basket body with multiple apertures defined in the basket body. In some cases, the filter liner is part of the junk basket and lines a junk basket frame. In some cases, the filter liner is arranged separate and upstream from the junk basket. The junk basket body can have a mesh size that is less than the mesh size of the filter liner. In this configuration, the smaller debris that can pass through the filter liner may be collected and retained by the junk basket.

The first sampler 136 of the first section 112 (or the body of the first sampler) extends from a first end 150 (housing connection end) to a second end 152 (swivel connection end). The body 138 of the first sampler 136 is connected to the housing 124 of the first section 112 at the first end 150 of the first sampler 136. The second end 152 of the first sampler 136 of the first section 112 connects to the second section 114 of the structure 110 of the tool 100. The outlet 142 of the first sampler 136 is arranged between the inlet 140 of the first sampler 136 and the first end 150. In this configuration, the inlet 140 is arranged downhole of the outlet 142 when the tool 100 is in a wellbore. In some cases, the inlet is arranged at or adjacent to the second end of the body or first sampler and/or the outlet is arranged at or adjacent to the first end of the body or the first sampler.

The suction pump 132 is fluidly connected to the fluid channel 144 such that, when in use, the suction pump 132 applies a suction force to the fluid channel 144 and conveys the fluid from the inlet 140 to the outlet 142. The suction force draws in fluid and debris from the environment of the wellbore through the inlet 140, and through the filter liner 146 and junk basket 148.

The first section 112 defines a first section diameter. In some cases, the first section diameter is taken at the housing or the body. The first section diameter may be taken at the location on the axis 108 of widest or largest diameter of the first section.

The second section 114 is rotationally mounted to the second end 152 of the first sampler 136 by a first swivel joint 156. The second section 114 is centered on the tool axis 108 and is rotatable on the center axis 108. The second section 114 is rotatable relative to the first section 112 and the motor 134 is operable to rotate the second section 114 relative to the first section 112.

The second section 112 includes a first hub 154 with a first swivel joint connector 156. The swivel joint connector 156 of the second section 114 attaches to the second end 152 of the first sampler 136 of the first section 112 of the tool 100. The swivel joint connector 156 mounts the second section 114 to the first section 112 so that the second section 114 and first section 112 are aligned axially along the axis 108 and are rotatable relative to each other on the axis 108.

The second section 114 also includes a second hub 158 and multiple extendable brushing arms 160 (e.g., a plurality or set of extendable brushing arms). The extendable brushing arms 160 extend from the first hub 154 and the second hub 158. Each brushing arm 162 in the multiple extendable brushing arms 160 includes a first link 162*a* (first strut), and a brush 162*b*, and a second link 162*c* (strut).

The first link 162*a* is hingably connected to the first hub 154 at one end and hingably connected to the brush 162*b* at an opposite end. The second link 162*c* is hingably connected to the second hub 158 at one end and hingably connected to the brush 162*b* at the other end. In this configuration, the first and second links 162*a*, 162*c* can pivot about hinges to extend or retract the brush arm 162 (e.g., the brush 162*b*).

The brush 162*b* can also pivot about hinges to maintain a flat, front contact face 166. The brush 162*b* includes bristles 168 that scrape and dislodge the scale deposit on a wellbore casing when the second section 114 is rotated by the rotary motor 134. The bristles 168 and/or the brush 162*b* can be made of or comprise a metal alloy, steel alloy, or rubber. The bristle and/or brush material can be chosen based on the hardness or the scale, or anticipated hardness of the scale, attached to the wall of the casing. In some case, the brushes releasably attached to the first and second links, such that the brush can be replaced or customized to an anticipated scale type or hardness. In some cases, the bristles are releasably attached to the brush, such that the bristles can be replaced or customized to an anticipated scale type or hardness. In some cases, the brush arm can is releasably attached to the hubs such that the brush arm can be replaced or customized to an anticipated scale type, scale hardness, or casing size.

The multiple brush arms 160 define a second section diameter. In the retracted position, the second section diameter is a retracted second section diameter. In the extended position, the second section diameter is an extended second section diameter. The extended second section diameter is greater than the retracted second section diameter. In the extended position, the contact face 166 contacts or presses onto the interior surface of the wellbore casing and/or contacts an attached scale deposit fixed to the interior surface of the wellbore casing. The retracted second section diameter may be about 2.25 incudes to about 3.5 inches. The extended second section diameter may be about 1.5 inches to about 7 inches.

In the retracted position, the contact faces 166 of the brushing arms are arranged within a recess 169 (e.g., a slot or groove) defined in the second section 114 of the structure 110. The recess is at least partially defined between the first hub 154 and the second hub 158. To move from the retracted position to the extended position, the multiple brushing arms 160 flex or hinge at the brushes 162*b* so that the contact face 166 of the brushes moves radially away from the axis 108 and towards a wellbore casing. To move from the extended position to the retracted position, the multiple brushing arms 160 flex or hinge at the brushes 162*b* so that the contact face 166 of the brushes moves radially towards from the axis 108 and away from a wellbore casing.

The brushing arms 162 connect to the motor 134 by a rotating head. The computer sub-system or a control unit at the surface can control and/or power the brushing arms to extend and/or retract the brushing arms. The motor can be a dedicated brush motor or can be the rotary motor.

The second hub 158 also includes a second connector 170. The second connector 170 connects the second section 114 to the third section 116. In this configuration, the second section 114 is rotationally fixed to the third section 116. The third section 116 is rotatable relative to the first section 112 due to the first swivel joint 156. In some cases, the second connector is a second swivel joint. The second section is rotatable relative to the third section due to the second swivel joint. In use, the motor 134 extends the brush arms 162 and rotates the second section 114 and the third section 116 while the first section 112 remains stationary is still or stationary.

The third section 116 is arranged at or forms the second, free end 104 of the structure 110 of the tool 100. The third section 116 connects to the second hub 158 of the second section 114 and is centered on the tool axis 108. The third section 116 includes a second sampler 172. The second sampler 172 is a junk basket with an open end 174, a closed end 176, and a wall 178 extending between the open end 174 and the closed end 176. The closed end and/or wall may be formed by a mesh, permeable membrane, or include multiple apertures to permit the flow of fluid while capturing solid debris dislodged from the wellbore casing. The open end 174 faces second section 114 of the tool 100. The open end may be distanced from the second hub. In some cases, the open end is arranged on the second hub and the second hub defines an aperture aligned with the open end.

The first junk basket and second junk basket can have the same volume or different volumes. The first and second junk baskets may have volumes of about 10 liters. In some cases, the junk basket sizes, volumes, shapes, and materials are customized for the wellbore size.

The second section 114 is includes a shaft 180 arranged on and extending along the axis 108. In some cases, the shaft extends through apertures of the first and second hubs to connect and rotationally constrain the first section to the third section.

The third section 116 defines a third section diameter. In some cases, the third section diameter is taken at the second sampler. The third section diameter may be taken at the location on the axis 108 of widest or largest diameter of the third section.

The tool 100 also includes a computer sub-system 190 with a controller 192, and one or more processors 194, and a non-transitory computer-readable medium storing instructions executable by the one or more processors 194 to perform operations. The operations include prompting the rotary motor 134 to rotate the second section 114 relative to the first section 112 and prompting the suction pump 132 to apply suction to the fluid channel 144 of the first sampler 136 of the first section 112. In some cases, the operations also include prompting the plurality of brushing arms to move from the retracted position to the extended position. Some operations include prompting the brushing arms to move from the extended position to the retracted position. The third section 116 is moved upwards and retracted towards the first section 112 via the central shaft 180, which allows for the brushing arms segments of section 114 to move outwards into extended position. The degree of the arms extension is dependent on the inner diameter or interior surface 120 of the pipe where the tool is deployed. During retracting motion for the brushing arms, the third section 116 is extended downwards relative to the first section 112, which allows the brushing arms segments of section 114 to move inwards to retracted position.

In the retracted position, the retracted second section diameter is less than or equal to the first section diameter. The retracted second section diameter is also less than or equal to the third section diameter. In the extended position, the extended second section diameter is greater than the first section diameter. The extended second section diameter is greater than the third section diameter. In this configuration, the tool 100 can translate axially within the wellbore and can pass through locations in the wellbore casing with scale deposits. When an operator or computer sub-system determines that the tool should move into a cleaning or extended position, the brush arms extend to contact the scale deposit or interior surface of the wellbore casing, for example adjacent a scale deposit.

Figure 2A:
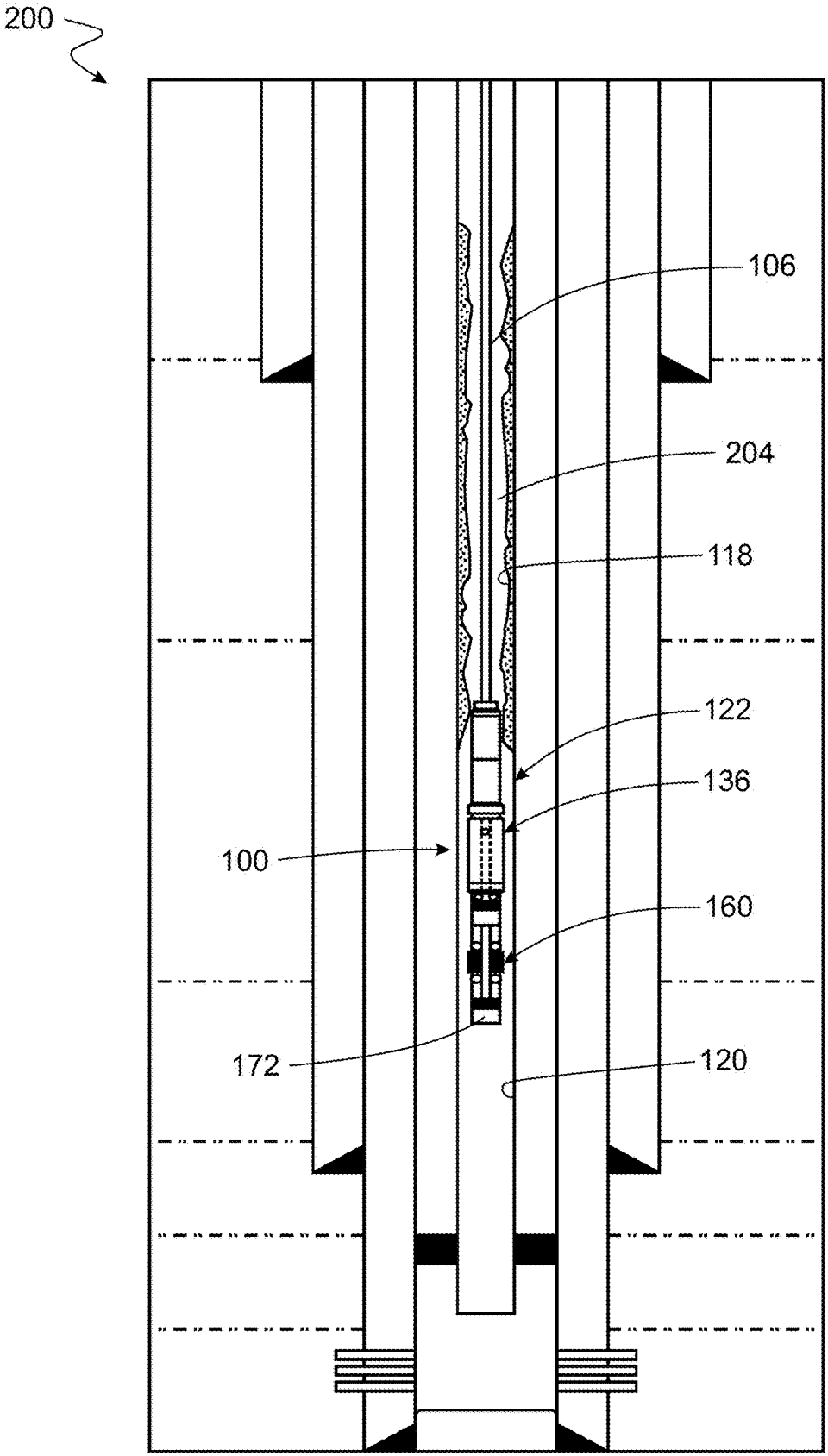
FIGS. 2A-2D are cross sectional side views of the downhole tool during operation in a wellbore.

FIGS. 2A-2D are cross sectional side views of the downhole tool 100 during operation in a wellbore system 200. The wellbore system 200 includes a wellbore 202 lined with the wellbore casing 122. The wellbore casing 122 has an interior surface 120 that defines an interior volume and a casing diameter. In some cases, the computer sub-system may be part of the wellbore system and connected to the cleaner-sampler tool. The wellbore system 200 includes the casing debris 118 (partial blockage) attached to the interior surface 120 of the casing 122. The debris 118 narrows the casing 122 and reduces the operational diameter of the casing 122. The debris 118 forms a narrowed passage 204 in the interior volume of the wellbore casing 122. The downhole tool 100 can pass through the narrowed passages of the casing 122 in the retracted position (FIG. 2A). The movement of the tool 100 in the wellbore 202 along the axis 108 (e.g., uphole or downhole) is controlled by the wireline 106.

Figure 2B:
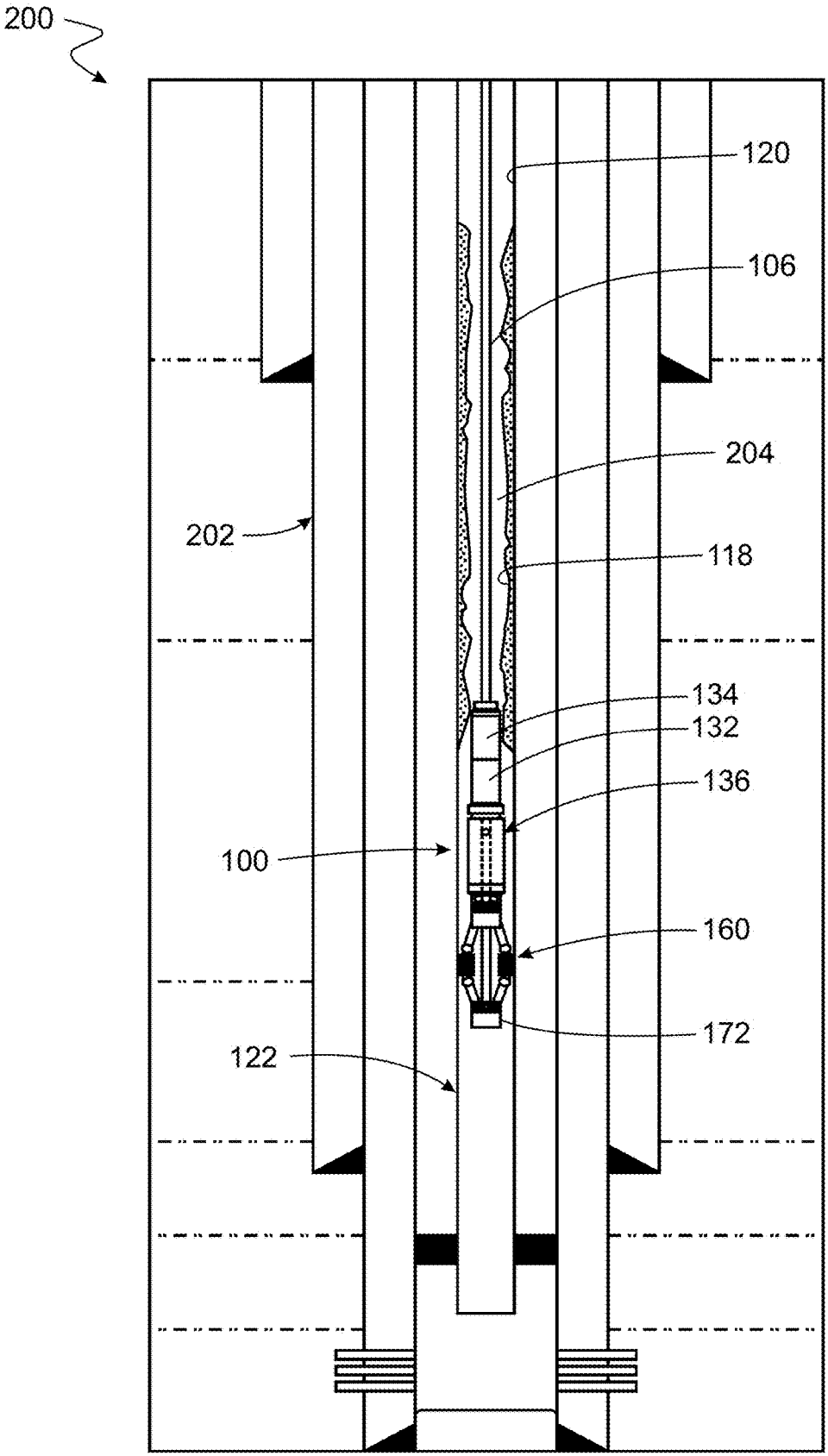

After passing through the narrowed passage 204 in the retracted position, the multiple expandable brushing arms 160 transition from the retracted position to the extended position (FIG. 2B). In the extended position, the expanded second section diameter is about equal to the diameter of the wellbore casing 122 or to the diameter of the narrowed passage 204. The rotary motor 134 rotates the second section 114 relative to the first and third sections 112, 116 so that the expanded brush arms 160 rotate relative to the first and third sections 112, 116.

The rotating brushes engaged, rupture, and dislodge the scale from attachment to the interior surface 120 of the casing 122. The dislodged debris floats or mixes with the fluid in the interior volume of the wellbore casing 122. The suction pump 132 sucks the debris-fluid mixture into the inlet 140 of the first sampler 136 and through the first junk basket and filter liner (FIG. 1A).

The first sampler 136 retains the dislodged debris 118 in the tool 100.

Figure 2C:
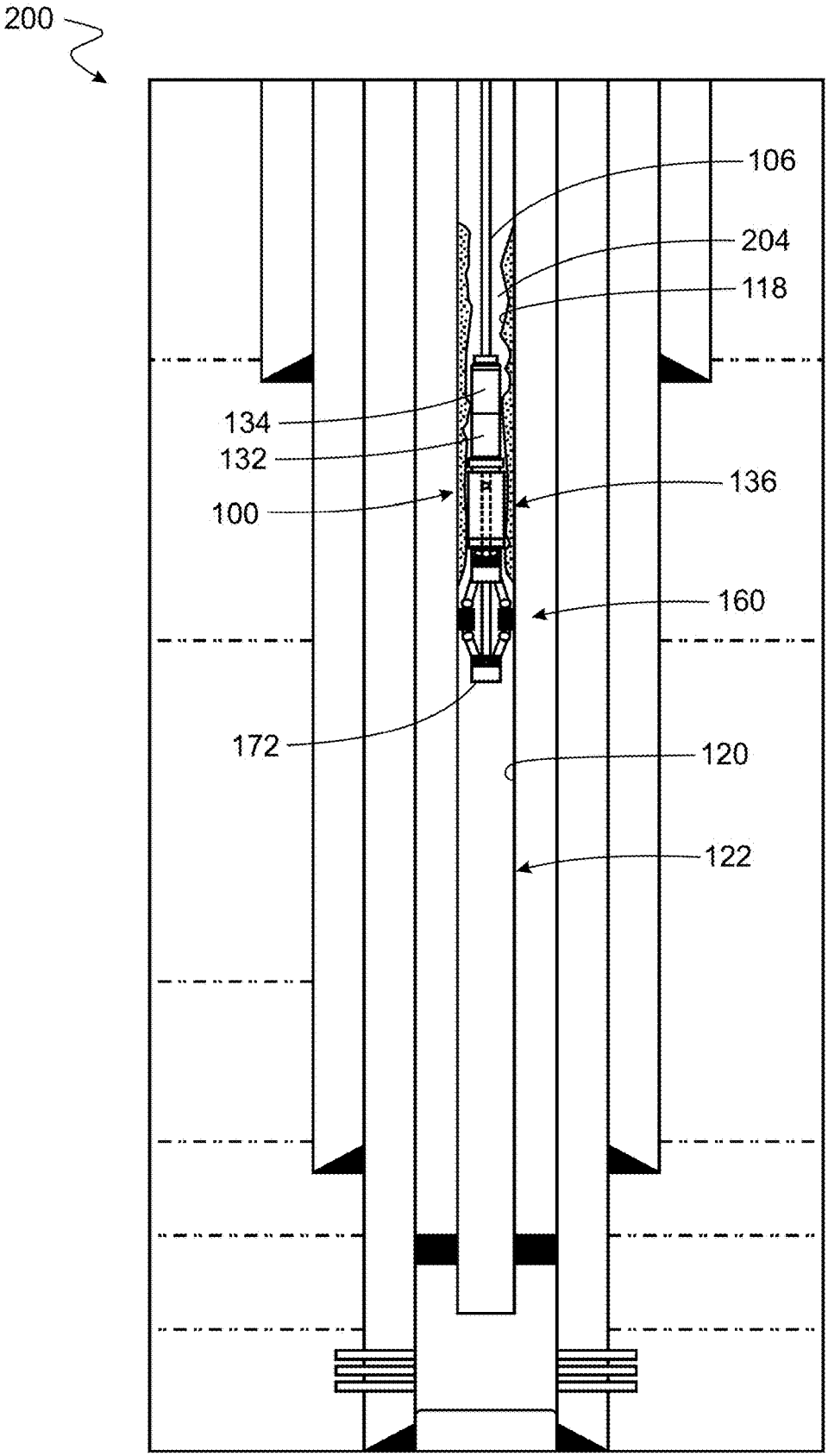

To dislodge debris 118 and eliminate the narrowed passage 204, the wireline 106 moves the tool 100 with the brushing arms in the extended position, axially within the wellbore 202 (FIG. 2C). The suction pump 132 and rotary motor 134 maintain operation during axial translation within the wellbore 202 so that the debris in the narrowed passage 204 is dislodged and collected. Uphole movement of the tool 100 also moves the fluid-debris mixture through the second sampler 172. As the tool moves uphole, or as the debris solids settle in the fluid, the second sampler captures and retains the dislodged debris 118 in the second junk basket (FIG. 1A). The tool can be translated axially along the wellbore multiple times in the same run to thoroughly clean all debris from the interior surface of the casing.

Figure 2D:
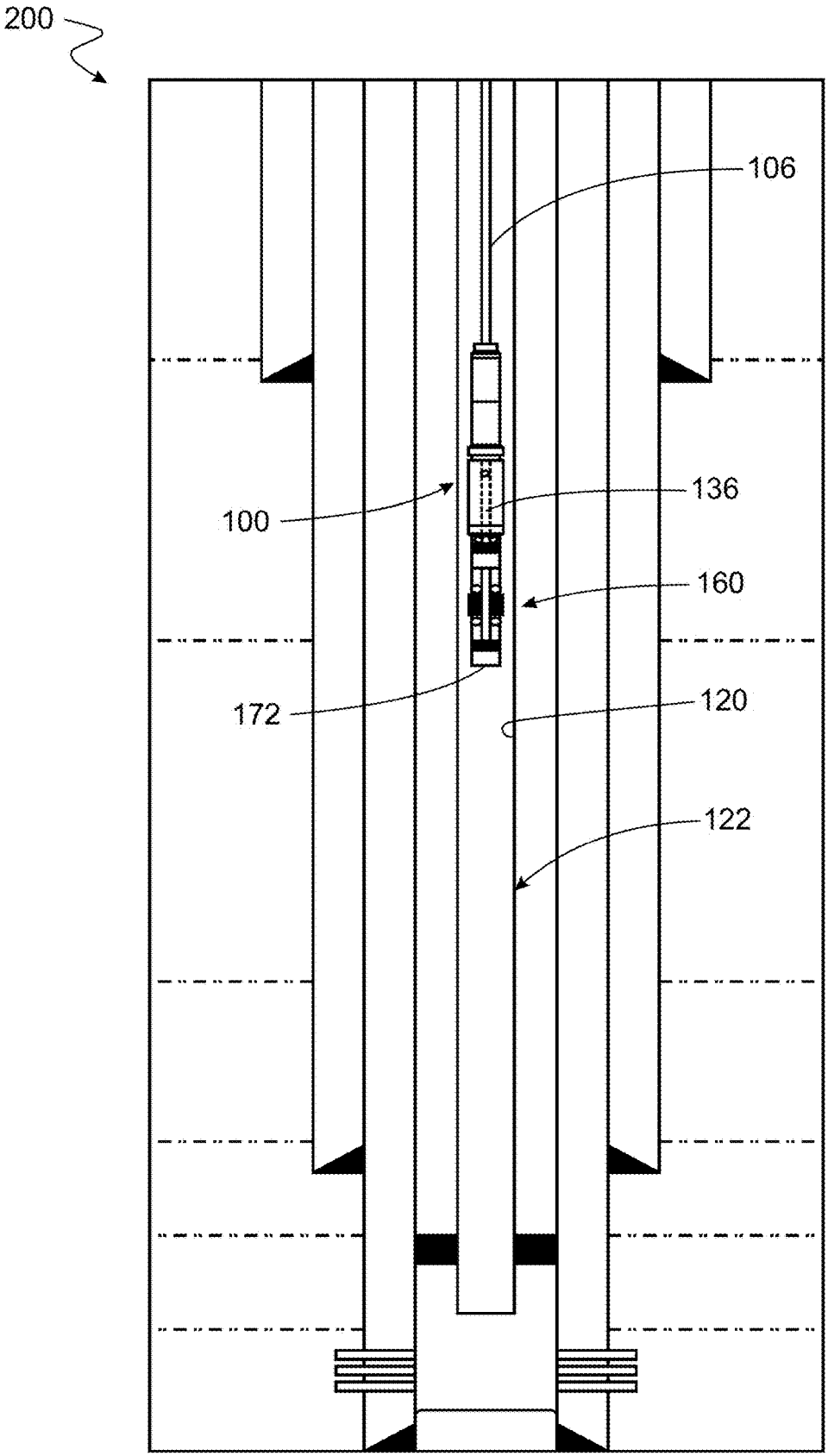

When the partial blockage 118 is removed from the interior surface 120 of the casing 122, the brushing arms 160 of the tool 100 can move into the retracted position (FIG. 2D). The retracted tool 100 can then be removed from the wellbore 202.

Figure 3:
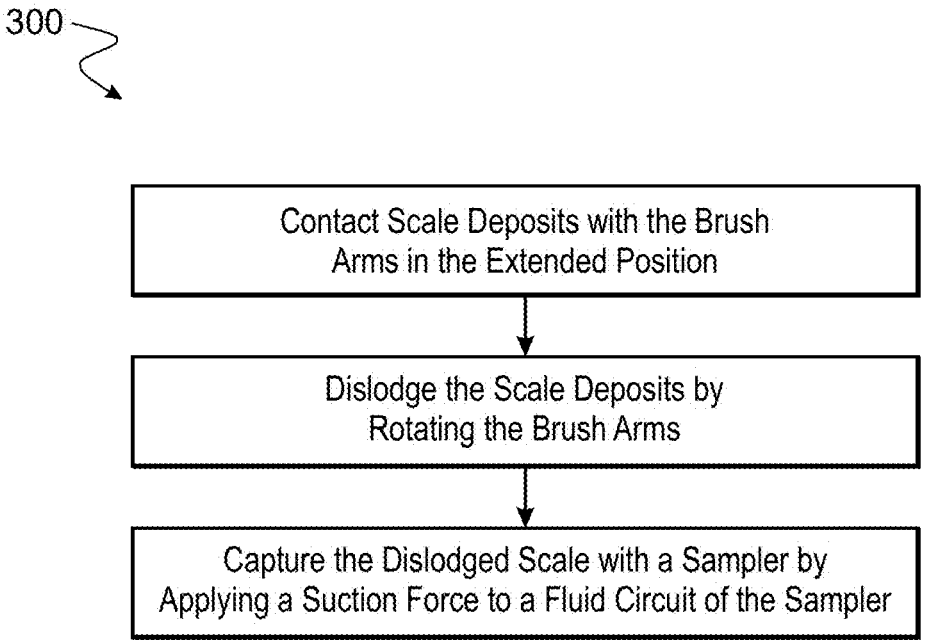
FIG. 3 is a view of a flow chart of a method for using a cleaning and sampling downhole tool.

FIG. 3 is a view of a flow chart of a method 300 for using a cleaning and sampling downhole tool. The method 300 is described with reference to the system 200 in FIGS. 2A-2D, however, the method 300 may be applied to any applicable system and/or tool. Before deploying the tool 100, drift runs are conducted into the well by running several sizes of gauge cutters (drift tools) to determine the accessibility of wellbore casing's inner diameter.

Where a partial obstruction of debris is present in the casing, the inner diameter of the casing is reduced. If the inner diameter of the casing at the partial obstruction is greater than the retracted diameter the tool 100 (e.g., the retracted second diameter of the second section), the tool 100 can pass through the casing, passed the partial obstruction. An operator or computer subsystem can determine that the tool 100 has passed the partial obstruction when no slack off weight is measured when the tool 100 is run in hole across the obstruction depth. The method 300 includes running in hole by a wireline the tool 100 with the brushing arms 160 in the retracted position.

The wellbore casing 122 has a partial blockage 118 that narrows but does not completely block off a downhole section of the wellbore casing. The tool 100, in the retracted position, passes the partial blockage.

The method 300 then includes moving or prompting the multiple brushing arms 160 to move from the retracted position to the extended position. In the extended position, the contact faces 166 of the brushing arms 160 contact the interior surface 120 of the wellbore casing 122 or the scale deposits 118 (partial blockage) attached to the interior surface 120 of the wellbore casing 122. A compute subsystem or operator may prompt the rotary motor 134 to rotate the second section 112, including the multiple arms 160. The bristles 168 of the brushes 162*b* of the brushing arms 160 scrape, dislodge, clean, and scratch of the attached scale deposit 118 from the wellbore casing 122. The dislodged scale 118 mixes with the fluid in the wellbore casing 122.

The method 300 also includes capturing the scale deposits mixed with the fluid using the first sampler 136 or second sampler 172. Capturing the scale deposits includes prompting the suction pump 132 to apply a suction force to the fluid channel 144 (e.g., the fluid circuit of the first sampler). The suction force draws in or pulls the fluid-debris mixture into the inlet 140 of the first sampler 136. In some cases, uphole movement of the tool 100 by the wireline 106 passively moves fluid through the second sampler 172 (e.g., a filter or junk basket) to separate the debris 118 from the fluid. As the fluid moves from the inlet 140 to the outlet 142 by the fluid channel 144, the fluid-debris mixture passes through the first junk basket of the first sampler 136 and through the filter line of the first sampler 136. The junk basket and the filter liner separate the debris from the fluid by permitting fluid flow while blocking the movement of solids (e.g., debris). The filter line and junk basket capture and retain the dislodged debris 118 in the first sampler 136 so that the debris type may be identified at the surface. An operator can dismantle the junk baskets at surface. The sample of debris will be collected from the junk baskets and delivered to the laboratory for further downhole sample analysis.

While rotating the brushing arms 160 and applying a suction force to the fluid channel 144, the wireline 106 may translate the tool 100 within the wellbore to clean and collect the debris from other axial locations in the wellbore. For example, the wireline may move the tool uphole or downhole to dislodge additional scale deposits formed on the interior surface of the wellbore casing. After the casing 122 has been cleaned of the partial blockage 118 and the debris 118 has been collected by filtering the debris-fluid mixture, the tool 100 returns to the retracted position and the wireline 106 can convey the tool 100 to the surface. The first and second samplers 136, 172 can be removed or accessed to retrieve and remove the debris sample retained in the first and second sampler 136, 172. The extracted debris can then be tested to determine the type and/or composition of the debris. A subsequent treatment plan for the wellbore casing may be determined based on the determined scale type collected by the first and second samplers 136, 172.

In some tools, the first, second, and third sections are each rotatable relative to each other. For example, the first section is rotatable relative to the second and third sections and the second section is rotatable relative to the first and third sections.

While a sampler 136 with a filter liner set 146 having three filter liners 146*a-c* has been described, some samplers have a single filter liner having a mesh size of about 20 microns to about 100 microns.

A number of embodiments of the invention have been described. Nevertheless, it will be understood that various modifications may be made without departing from the spirit and scope of the disclosure. Accordingly, other embodiments are within the scope of the following claims.

What is claimed is:

1. A downhole cleaner-sampler device comprising:
- a first connection end;
- a second free end, where the first end and second end define a longitudinal device axis; and
- a structure extending from the first end to the second end of the device, the structure comprising:
- a first section comprising:
- a housing with a link jar at a first end of the device,
- a suction pump arranged in the housing,
- a rotary motor arranged in the housing, and
- a first sampler comprising:
- a body connected to the housing, the body defining an inlet, an outlet, and a fluid channel connecting the inlet and outlet, wherein the suction pump is fluidly connected to the fluid channel;
- a second section centered on the device axis and rotatable relative to the first section, the second section comprising:
- a first hub having a swivel joint connector attached to the first section of the device,
- a second hub, and
- a plurality of extendable brushing arms arranged between the first hub and the second hub, each brushing arm comprising:
- a first link hingably connected to the first hub,
- a second link hingably connected to the second hub, and
- a brush arranged between the first and second links, wherein the brush is hingably connected to the first link and hingably connected to the second link; and
- a third section arranged at the second end of the structure of the device, wherein the third section connects to the second hub of the second section and is centered on the device axis, the third section comprising:
- a second sampler,
- wherein the second section is longitudinally axially between the first section and the third section along the device axis.

2. The device according to claim 1, wherein the first sampler further comprises at least one filter liner arranged in the fluid channel between the inlet and outlet.

3. The device according to claim 1, wherein the first sampler further comprises a junk basket arranged in the fluid channel between the inlet and the outlet.

4. The device according to claim 3, wherein the junk basket comprises at least one filter liner.

5. The device according to claim 1, wherein the first sampler extends from a first end to a second end, wherein the body is connected to the housing at the first end, wherein the outlet of the first sampler is arranged between the inlet of the first sampler and the housing first end of the housing.

6. The device according to claim 5, wherein the inlet of the first sampler is arranged at or adjacent to the second end of the body.

7. The device according to claim 5, wherein the swivel joint connector is mounted to the second end of the first sampler.

8. The device according to claim 1, wherein the second sampler is a junk basket having an open end, a porous closed end, and a wall extending between the open end and the closed end.

9. The device according to claim 8, wherein the wall comprises a permeable membrane or mesh.

10. The device according to claim 8, wherein the second section is rotatable relative to the third section.

11. The device according to claim 10, wherein the second hub comprises a second swivel joint, wherein the second swivel joint is connected to the third section of the body.

12. The device according to claim 1, wherein the second section is operable to move between a retracted position and an extended position.

13. A method comprising:

providing a cleaner-sampler device in a wellbore casing with a partial blockage, the device comprising:

a first section having a first sampler defining an inlet, an outlet, and a fluid channel extending between the inlet and the outlet, a second section having a plurality of brushing arms in the retracted position, and a third section having a second sampler, wherein the first section, the second section and the third section are connected along a longitudinal device axis of the cleaner-sampler device, wherein the second section is longitudinally axially between the first section and the third section along the device axis;

contacting scale deposits attached to an interior surface of the wellbore casing by brushes of each of the brushing arms in the plurality of brushing arms, wherein the plurality of brushing arms are in the extended position;

dislodging the scale deposits attached to the interior surface of the wellbore casing; and capturing the dislodged scale deposits in the first sampler by applying a suction force to the fluid channel by a suction pump in the first section of the device.

14. The method according to claim 13, wherein dislodging the scale deposits attached to the interior surface of the wellbore casing comprises rotating the second section relative to the first section.

15. The method according to claim 13, further comprising capturing dislodged scale deposit in the second sampler by moving uphole.

16. The method of claim 15, wherein the second sampler comprises a junk basket that retains the dislodged scale deposit as the cleaner-sampler device moves uphole.

17. The method according to claim 13, wherein dislodging the scale deposits attached to the interior surface of the wellbore casing and capturing the dislodged scale deposits in the first sampler by applying the suction force to the fluid channel, occur simultaneously.

18. The method according to claim 13, further comprising:

filtering the dislodged scale deposits from fluid captured by the first sampler by applying the suction force to the fluid channel; and expelling filtered fluid from the outlet of the first sampler.

19. The method of claim 18, further comprising positioning a filter liner set in the fluid channel between the inlet and the outlet to filter the dislodged scale deposits from the fluid captured by the first sampler.

20. The method of claim 13, further comprising connecting and rotationally constraining the first section to the third section.

* * * * *